United States Patent [19]

Taylor et al.

[11] 4,362,704

[45] Dec. 7, 1982

[54] COBALT LEACHING PROCESS

[76] Inventors: Patrick R. Taylor, 838 Truman, Moscow, Id. 83843; Jonathan P. Vanderloop, 16885 Crestview Dr., Victorville, Calif. 92392

[21] Appl. No.: 214,657

[22] Filed: Dec. 8, 1980

Related U.S. Application Data

[63] Continuation of Ser. No. 98,350, Nov. 29, 1979, abandoned.

[51] Int. Cl.[3] ..... C01G 51/10

[52] U.S. Cl. ..... 423/150; 75/104

[58] Field of Search ..... 423/87, 140, 150, 27; 75/104

[56] References Cited

U.S. PATENT DOCUMENTS

| | | | |
|---|---|---|---|
| 981,451 | 1/1911 | McKechnie | 75/104 |
| 3,884,831 | 5/1975 | Bloom | 423/27 |
| 3,886,257 | 5/1975 | Snell | 75/104 |
| 4,166,737 | 9/1979 | DeMarthe | 75/104 |

FOREIGN PATENT DOCUMENTS

| | | | |
|---|---|---|---|
| 2754784 | 6/1978 | Fed. Rep. of Germany . | |
| 2203 | 8/1970 | United Kingdom | 423/150 |

*Primary Examiner*—Brian E. Hearn

*Attorney, Agent, or Firm*—James R. Thornton

[57] ABSTRACT

Cobalt is separated from a cobalt arsenic sulfide ore or concentrate by means of leaching at substantially atmospheric pressure with a ferric sulfate-sulfuric acid solution.

13 Claims, No Drawings

COBALT LEACHING PROCESS

This is a continuation of application Ser. No. 098,350, filed Nov. 29, 1979, now abandoned.

This invention relates to a process for separating cobalt from a cobalt arsenic sulfide concentrate or ore such as cobaltite.

BACKGROUND OF THE INVENTION

The element cobalt is becoming increasingly important to our technical world. It is used in many applications where there are no known substitutes. The importance of cobalt to the U.S. economy has been illustrated recently by the drastic rise in the price of cobalt due to the difficulties in Zaire. With the United States importing 98% of its cobalt, we are particularly affected. The major mineral in the cobalt ore reserves of the world is cobaltite (CoAsS), occurring in many parts of the world such as in Canada, India, Australia, the U.S.S.R., Sweden, Finland, Austria, Spain, Korea, and the United States. These deposits have, for the most part, remained unexploited due to the lack of a viable metallurgical process. The U.S. deposit located in Cobalt, Idaho, is the largest known domestic reserve of cobalt. Several efforts have been made to commercially exploit cobaltite ores, without notable success. For example, in the early 1950's a small scale plant was built to recover cobalt from the Idaho deposits in which the process was based on a combined roast and flotation procedure. However, recoveries were disappointing and the process was not scaled up to full commercial operation. Subsequent attempts to use a process employing an acid-oxidizing leach under pressure were also disappointing due to severe corrosion and erosion problems which ultimately required expensive materials of construction.

Other refining and extraction processes have been researched for recovery of cobalt from cobaltic ores or concentrates, most of which have been based on a combined roast-leach procedure. See, for example, Shelton et al., *U.S. Bureau of Mines R.I.* 4172, January 1948 and Huttl, *Engineering and Mining Journal,* October 1951, pages 74–80, 121. Sill, *Chemical Engineering,* Jan. 13, 1958, pages 80–82, announced an alkaline ore oxidation and leach process for cobaltite which required autoclave pressures. Borvali, French Pat. No. 1,125,038, describes a leaching process with $HNO_3$ and $H_2SO_4$ under pressure and claims a high yield of cobalt.

Many procedures for concentrating cobaltite ores have been proposed, most of which involve a flotation procedure. See, for example, Canadian Dept. of Mines Report No. 724 and U.S. Bureau of Mines Report Nos. 4012 and 4279 as well as the *Proceeding of Australian Institute of Mineral Metallurgy,* No. 257, p. 37 (1976). However, such procedures have not found commercial acceptance.

Patents which disclose the recovery of cobalt from ores or concentrates include U.S. Pat. No. 2,403,640, U.S. Pat. No. 2,573,865, U.S. Pat. No. 2,694,005, U.S. Pat. No. 2,694,006, British Pat. No. 719,280, U.S. Pat. No. 2,690,391, U.S. Pat. No. 2,711,950, Canadian Pat. No. 571,320, U.S. Pat. No. 2,647,827, U.S. Pat. No. 2,647,828, U.S. Pat. No. 3,616,331, U.S. Pat. No. 3,773,891, U.S. Pat. No. 3,146,091 and U.S. Pat. No. 2,805,936. The ores of U.S. Pat. Nos. 2,647,827 and '828, 3,616,331, 3,146,091 and 3,773,891 are not an arsenic containing ore such as cobaltite. Schaufelberger U.S. Pat. No. 2,805,936 relates to cobaltite ore and appears to describe the acid-oxidizing leach process described above which requires high pressure conditions.

DESCRIPTION OF THE INVENTION

The present invention provides a process for separating cobalt from cobalt-arsenic sulfide ores or concentrates by a direct leaching procedure which results in excellent recovery of cobalt without the need of exotic or expensive materials of construction. The direct leaching process also avoids the environmentally undesirable roasting processes which generate sulfur oxides and release arsenic. The process of this invention may be applied to ores or concentrates of cobaltite or cobalt arsenic sulfides. It is readily operated at substantially atmospheric pressures, thereby enabling the use of conventional materials of construction and avoiding the high expense and excessive maintenance problems associated with exotic materials of construction and high pressure operation.

According to the present process, the cobalt containing ore or concentrate is subjected to leaching with an aqueous solution containing ferric sulfate and sufficient sulfuric acid to keep the metal sulfates in solution. The leaching procedure takes place at substantially atmospheric pressure at temperatures of from about ambient up to about boiling temperature, preferably at least about 50° C. When used herein, "substantially atmospheric pressure" means atmospheric pressure and slight positive and negative variations from atmospheric. Oxygen or air is preferably bubbled through the leaching liquor in order to regenerate the ferric sulfate during the leaching process.

The concentration of ferric sulfate in the leaching liquor may be in the range of from about 10 grams per liter to solubility, preferably in the range of about 100 to 200 grams per liter. The sulfuric acid concentration should be sufficient to keep the metal sulfates in solution and generally is in the range of about 10 to 300 grams $H_2SO_4$ per liter, with about 100–150 grams per liter preferred.

According to a preferred procedure of the invention, cobaltite containing ore or concentrate is ground to a size which is predominantly about 150 to 400 mesh and slurried with the leaching solution to give a pulp density of about 10% to 40%. The slurry is heated to a temperature in the range of about 85°–100° C. under atmospheric pressure. The hot slurry is agitated such as by suitable stirring means and oxygen or air bubbled through the slurry. Leaching is continued for a period of time sufficient to extract the cobalt which goes into solution as the sulfate, generally for up to about 24 hours. The sulfur remains in the solid elemental form or as dissolved sulfate and the arsenic precipitates as ferric arsenate. The ferric arsenate and other insoluble materials can be removed from the pregnant leach liquor by decantation or filtration to leave a filtrate containing the soluble cobalt sulfate as well as the soluble sulfates of other metals which may be present in the ore, such as iron, nickel and copper. The cobalt is separated and purified by conventional procedures such as extraction by a highly selective cobalt to iron ion exchange solvent or resin such as Amberlite DPL or by selective precipitation methods. The cobalt can then be recovered and purified such as by hydrogen reduction or electrowinning.

The cobalt depleted solution contains soluble ferric sulfate which may be treated to remove copper and other impurities and then recycled for reaction with fresh ore or concentrate.

The process according to our invention results in extractions of greater than about 90% of the cobalt within 24 hours, with more rapid extractions being possible with finer grinding. It may also be used to concentrate the cobalt in cobalt containing ores.

The following examples are presented to illustrate the process of the present invention.

EXAMPLE 1

A 47 gram sample of cobalt arsenic sulfide ore from Blackbird, Idaho containing, in addition to cobaltite, chalcopyrite, pyrrhotite, arsenopyrite, quartz, biotite, pyrite and silicates, had the following assay; 0.39% cobalt, 1.77% copper, 0.11% nickel, 0.57% arsenic, 38.65% iron and about 19% sulfur. The ore was ground to 32% −200 mesh and slurried in 690 ml. of an aqueous solution containing 30 ml. of sulfuric acid and 129 grams per liter of dissolved iron as ferric sulfate. The resultant slurry was stirred and heated at 92° to 100° C. for 24 hours. Oxygen was bubbled through the heated slurry at a rate of about 0.02 liter per minute. Any water vapor from the slurry was condensed and returned to the reaction vessel. At the end of the 24 hour period, the slurry was filtered and the filtrate diluted with 10% nitric acid and analyzed for extracted cobalt using atomic absorption. It was found that 76% of the cobalt and 18% of the copper had been extracted.

Thus, although the ore contained more than four times as much copper as cobalt, the percentage of cobalt extracted was four times greater than copper, showing the selectivity of the present process.

EXAMPLE 2

A 47 gram sample of ore from the same source as Example I was found to assay 0.21% cobalt, 1.83% copper, 0.06% nickel, 0.17% arsenic, 24.0% iron, and about 15% sulfur. The ore was ground to about 70% −200 mesh and slurried with 690 ml. of a solution containing 30 ml. of sulfuric acid and 74 grams per liter of iron as ferric sulfate. The slurry was stirred and heated at 95° C. for 24 hours with bubbling oxygen as described in Example 1. After filtration, the filtrate was found to contain 72% of the initial cobalt.

EXAMPLE 3

The procedure of Examples 1 and 2 was repeated with the same ore as described in Example 2, using 665 ml. of solution containing 5 ml. of sulfuric acid and 146 grams per liter of iron as ferric sulfate. It was found that 81% of the cobalt and 48% of the copper had been extracted.

EXAMPLE 4

The procedure of Example 2 was followed except 690 ml. of solution was employed and 5 g. of Guardian Plus dishwashing detergent was added to provide a wetting agent. Air was bubbled through the solution which was heated at 98° C. Analysis of the filtrate showed that 93% of the cobalt and 35% of the copper had been extracted.

The use of the wetting agent allows finer grinds and substitution of cheaper air for oxygen without sacrificing cobalt extraction. The wetting agent suppresses any tendency for the finer ore particles to float with the oxygen or air.

EXAMPLE 5

The procedure of Example 4 was repeated except the solution contained 36 grams per liter of iron and no wetting agent was added. Analysis of the filtrate showed that 40% of the cobalt and 12% of the copper had been extracted.

Although it is preferred that the extraction process be conducted with agitation, static conditions may also be employed. For example, static vat leaching or heap or dump leaching of ore or concentrate may be advantageous where it is impractical or uneconomical to mine and crush or grind the ore or employ elevated leaching temperatures. In such static leaching procedures, ambient temperatures may be used with suitable adjustments of reagent concentrations and leaching times. The insoluble material is separated from the pregnant leach liquor and the soluble cobalt isolated from the leach liquor by conventional procedures as described above.

Various changes and modifications of the invention can be made, and to the extent that such variations incorporate the spirit of this invention, they are intended to be included within the scope of the appended claims.

What is claimed is:

1. The process for separating cobalt from cobalt arsenic sulfide-containing ore or concentrate which comprises contacting said ore or concentrate with an aqueous solution consisting essentially of about 10 to 300 grams per liter of sulfuric acid and at least about 10 grams per liter of ferric sulfate, at a temperature of from about ambient to the boiling temperature of said aqueous solution and at substantially atmospheric pressure, and thereby solubilizing and extracting said cobalt.

2. The process according to claim 1 in which oxygen or air is bubbled through said aqueous solution.

3. The process according to claim 1 in which said aqueous solution contains about 100 to 200 grams of ferric sulfate per liter.

4. The process according to claim 1 in which said ore or concentrate is of a particle size which is predominantly about 150 to 400 mesh.

5. The process according to claim 4 in which said aqueous solution contains about 100 to 200 grams of ferric sulfate and about 100 to 150 grams of sulfuric acid per liter, air or oxygen is bubbled through said aqueous solution and said temperature is about 85°–100° C.

6. The process according to claim 1 in which the extraction temperature is at least about 50° C.

7. The process according to claim 1 in which a wetting agent is present in the aqueous solution.

8. The process according to claim 1 in which the extraction temperature is about 85°–100° C.

9. The process according to claim 1 in which said ore is cobaltite.

10. The process according to claim 9 in which the hot aqueous solution is agitated for a period of time up to about 24 hours sufficient to solubilize and extract the major portion of cobalt in said ore or concentrate.

11. The process for separating cobalt from cobaltite which comprises extracting said cobaltite with an aqueous solution consisting essentially of about 100 to 150 grams of sulfuric acid and about 100 to 200 grams of ferric sulfate per liter at a temperature of about 85°–100° C., in which air or oxygen is bubbled through said aqueous solution with agitation, thereby solubilizing and extracting the major portion of said cobalt in said cobaltite.

12. The process according to claim 11 in which said cobaltite is first ground to a particle size which is predominantly about 150 to 400 mesh and then slurried with the leaching solution to give a pulp density of about 10 to 40%.

13. The process according to claim 11 in which said cobaltite is in the presence of chalcopyrite and said cobalt is selectively extracted from said chalcopyrite.

* * * * *